US005437249A

United States Patent [19]

Adams et al.

[11] Patent Number: 5,437,249

[45] Date of Patent: Aug. 1, 1995

[54] COMBINATION BURNER AND FLUE GAS COLLECTOR FOR WATER HEATERS AND BOILERS

[75] Inventors: Charles L. Adams; Richard C. Adams, both of Fort Worth, Tex.

[73] Assignee: PVI Industries, Inc., Fort Worth, Tex.

[21] Appl. No.: 143,937

[22] Filed: Oct. 27, 1993

[51] Int. Cl.[6] ..... F22B 5/00

[52] U.S. Cl. ..... 122/17; 126/361; 126/360 R

[58] Field of Search ..... 126/361, 91 A, 360 R, 126/360 A; 122/13.1, 17, 14, 32, 31.1

[56] References Cited

U.S. PATENT DOCUMENTS

| | | | |
|---|---|---|---|
| 2,602,440 | 7/1952 | Corns | 126/360 R |
| 2,982,346 | 5/1961 | Andersen . | |
| 3,402,985 | 9/1968 | Galvin . | |
| 3,460,895 | 8/1969 | Yamaguchi . | |
| 3,837,813 | 9/1974 | Ebeling et al. . | |
| 4,089,629 | 5/1978 | Baumgartner et al. . | |
| 4,493,309 | 1/1985 | Wedge et al. | 126/91 A |
| 4,545,329 | 10/1985 | Adams . | |
| 4,938,204 | 7/1990 | Adams . | |
| 4,981,112 | 1/1991 | Adams et al. | 126/360 R |
| 5,127,826 | 7/1992 | Acton et al. | 126/91 A |
| 5,145,354 | 9/1992 | Palm, Jr. . | |
| 5,184,949 | 2/1993 | O'Brien . | |
| 5,195,883 | 3/1993 | Hanna et al. . | |
| 5,241,949 | 9/1993 | Collier | 126/91 A |

*Primary Examiner*—Carroll B. Dority
*Attorney, Agent, or Firm*—Charles D. Gunter, Jr.

[57] ABSTRACT

A water heater is shown having a closed tank with an opening for receiving a combustion chamber, the interior of the tank normally containing water under pressure. A combustion chamber is located within the tank interior and includes a body portion having an open end adjacent the tank opening into which combustible fuel is introduced and ignited in the presence of air to create products of combustion. A flue collector is mounted on the exterior of the closed tank and has an annular chamber surrounding a flue opening for receiving the products of combustion for exhaustion to the atmosphere. An outer wall portion closes one end of the flue opening to provide a closed compartment within the collector which can be pressurized by an external blower. An inner wall portion of the collector has an opening which communicates with the combustion chamber. A fuel supply conduit carries a pressure plate and electrodes which provide controlled ignition of the fuel and air mixture within the opening in the inner wall portion to provide heat to the combustion chamber of the closed tank.

9 Claims, 3 Drawing Sheets

COMBINATION BURNER AND FLUE GAS COLLECTOR FOR WATER HEATERS AND BOILERS

BACKGROUND OF THE INVENTION

1. Field of the Invention

The present invention relates generally to gas, oil and gas/oil fired water heaters and boilers of the type having an internal combustion chamber for supplying heat to the closed tank interior of the device.

2. Description of the Prior Art

For many years, typical water heater construction provided for the flow of hot gas through a series of tubes mounted in vertical fashion between top and bottom support plates within the water heater tank. Water was circulated into and out of a chamber in the prior art devices located between the support plates. The water contacted and circulated about the exterior of the vertical tubes to effect heat transfer to heat the water.

The typical prior art gas, oil or gas/oil fired water heater thus featured a non-pressurized, external combustion chamber. The location of the combustion chamber on the exterior of the water heater resulted in lost heat and lower thermal efficiency. Also, the tubes and support plates were not easily accessible, which generally required disassembly of the entire tank for maintenance and replacement.

In U.S. Pat. Nos. 4,465,024; 4,545,329; and 4,938,204; all assigned to the assignee of the present invention, water heater designs are shown which feature one or more submergible, pressurized combustion chambers so that all combustion takes place in the water heater tank interior in a chamber surrounded by water. The resulting designs decrease heat loss and increase the thermal efficiency of the water heaters many times over that which was achievable with the prior art tube and plate arrangement.

The improved water heater designs featured an externally mounted, forced draft burner unit mounted on the exterior of the closed tank at a tank opening so that the burner nozzle extended in the direction of the combustion chamber for heating the combustion chamber. The burner unit had an inlet opening for the intake of air and an integral impeller for creating an overfire pressure within the combustion chamber. The products of combustion were routed from the combustion chamber to the annular chamber of a flue collector which was mounted about the tank opening, and from the annular chamber to the atmosphere. The nozzle of the forced draft burner extended through a flue opening in the flue collector for communication with the interior of the combustion chamber to supply heat to the combustion chamber.

While the above arrangement achieved a desired increase in efficiency, the forced draft burner unit was a heavy, bulky piece of equipment and was somewhat complicated in design. Because of the bulk of the unit, it was typically not possible to ship the burner preassembled with the water heater, requiring field installation. Because the burner nozzle extended through the flue collector opening to communicate with the combustion chamber, it was necessary to provide heavy insulation about the burner nozzle. The bulk of the force draft burner unit contributed to the overall length of the unit.

While prior art "boiler" construction typically featured horizontally arranged tubes instead of vertical tubes, many of the previously mentioned deficiencies existed in such units, particularly those units utilizing forced draft burners.

The present invention has as its object to provide a combination burner and flue gas collector for use in water heaters and boilers having internal combustion chambers of the type previously described.

Another object of the invention is to provide such a combination burner and flue gas collector of smaller overall dimensions than existing forced draft burner units permit, thereby allowing the burner to be assembled with the water heater or boiler at the factory.

Another object of the invention is to provide a combination burner and flue gas collector of simplified design which is more economical to manufacture.

Another object of the invention is to eliminate the heavy insulation which was necessary in the flue collectors of the prior art designs utilizing external, forced draft burners.

Another object of the invention is to provide a combination burner and flue gas collector which is pressurized by a remotely located fan unit connected by a length of conduit to the flue collector.

Another object of the invention is to provide a combination burner and flue gas collector with improved serviceability characteristics.

SUMMARY OF THE INVENTION

The improved water heater or boiler of the invention includes a closed tank with an exterior and an interior. The exterior of the closed tank has an opening therein and the interior normally contains water under pressure. A combustion chamber is located within the tank interior. The combustion chamber includes a body portion having an open end located adjacent the opening in the closed tank exterior into which combustible fuel is introduced and ignited in the presence of air to create products of combustion.

Passage means communicate with the combustion chamber for conducting products of combustion to the exterior of the closed tank for exhaustion to the atmosphere. A flue collector is mounted on the exterior of the closed tank having a flue opening therein which communicates with the open end of the body portion of the combustion chamber. The flue collector has an annular chamber surrounding the flue opening and separated therefrom, the annular chamber communicating with the passage means for conducting products of combustion to the atmosphere.

An outer wall portion defines a closed end for the flue opening of the flue collector at one extent thereof and an oppositely arranged, inner wall portion, together with the outer wall portion, defines a closed compartment within the flue collector which is surrounded by but separated from the annular chamber. The inner wall portion has a central opening therein which communicates with the combustion chamber.

Blower means are provided for pressurizing the closed compartment with air. Combustion means are mounted within the central opening in the inner wall portion of the flue collector for producing combustion. The combustion means includes a supply means for supplying fuel from a fuel source and an ignition means for igniting the fuel in the presence of air to produce products of combustion within the combustion chamber.

Preferably, the blower means is a fan unit which can be remotely located from the water heater and connected to the closed compartment of the flue collector by a suitable conduit. The blower conduit communicates with the closed compartment of the flue collector by means of a duct which passes transversely through the annular chamber of the flue collector to the closed chamber.

The combination burner and flue gas collector of the invention is adapted to be mounted on an exterior wall of a water heater or boiler having a closed tank with a wall opening and an internal combustion chamber communicating with the wall opening. The collector includes a generally cylindrical outer housing having an exterior sidewall and having an interior sidewall. A generally cylindrical inner housing is centrally located within the outer housing and has an exterior sidewall which is spaced apart from the interior sidewall of the outer housing to thereby create an annular chamber therebetween. The inner housing has an open interior which defines a flue opening for the collector which communicates with the combustion chamber. The annular chamber has at least one inlet for receiving products of combustion from the combustion chamber and one outlet for exhausting such products to the atmosphere. The inner housing has an outer wall portion which defines a closed end for the flue opening at one extent thereof and has an oppositely arranged, inner wall portion which together with the outer wall portion defines a closed compartment within the flue collector which is surrounded by but separated from the annular chamber. The inner wall portion has a central opening therein which communicates with the combustion chamber.

A blower duct passes transversely through the annular chamber of the collector to the closed compartment for pressurizing the closed compartment when the duct is connected to an external source of air pressure. Combustion means are mounted within the central opening in the inner wall portion of the collector for producing combustion. The combustion means include supply means for supplying fuel from a fuel source and ignition means for igniting the fuel in the presence of air to produce products of combustion within an associated combustion chamber.

Additional objects, features and advantages will be apparent in the written description which follows.

DETAILED DESCRIPTION OF THE INVENTION

Figure 1:
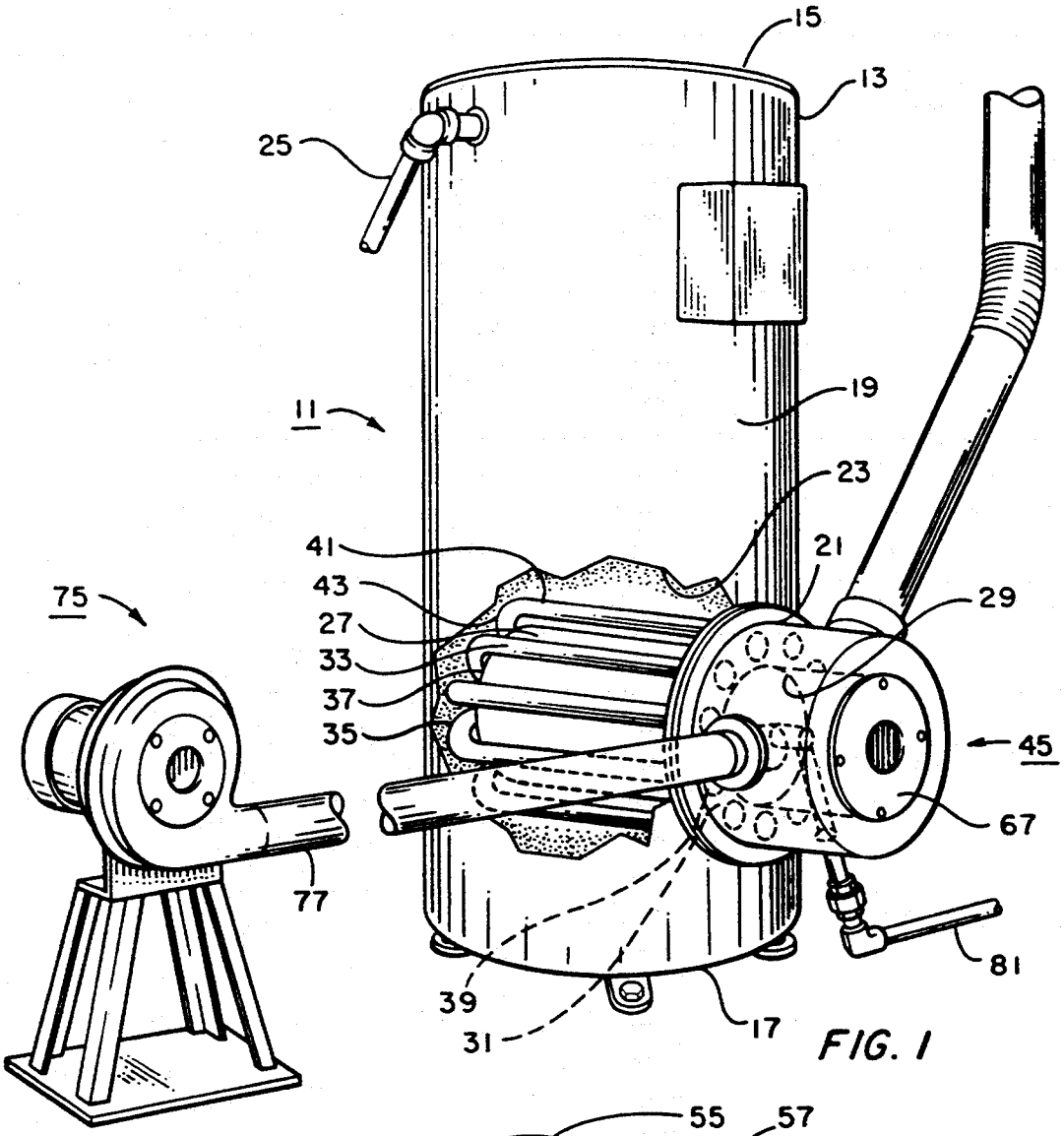
FIG. 1 is a perspective view of a water heater of the invention having the combination burner and flue gas collector mounted thereon, the tank being partly broken away to show the combustion chamber thereof.

FIG. 1 shows a water heater of the invention designated generally as 11. Although the preferred embodiment of the invention will be described in terms of a "water heater" suitable for commercial or residential use, the invention has application to other gas, oil and gas/oil fired appliances. In this discussion, the term "water heater" will be understood to encompass both water heaters and "boilers" of the type utilized for commercial/industrial use, as well as for residential use. For example, the combination burner and flue gas collector could be used with any appliance having a minimum "two-pass" construction or other multiple-pass boiler, or other appliance in which the products of combustion from the combustion chamber are routed back to a location adjacent the inlet end of the chamber to a flue collector. The return routing means could be the fire tubes of a submerged combustion chamber water heater, the fire tubes of a steel fire tube boiler, or the like. It is only necessary that the products of combustion make at least two passes through the device.

The water heater 11, shown in FIG. 1, includes a storage tank 13 having a top 15, a bottom 17 and connecting cylindrical sidewalls 19. The cylindrical sidewalls of the tank 13 define an exterior having at least one opening 21 therein. The tank 13 also has an interior 23 which normally contains water under pressure. The tank also has a water inlet (not shown) for cold water and a hot water outlet 25.

Although the water heater 11 is an upright, cylindrical body, it will be understood that the invention has application to other water heating appliances, including horizontally configured water heater and boiler units and units in which the opening 21 is provided in either the top or bottom rather than in the sidewalls of the device.

The water heater 11 includes a combustion chamber 27 mounted within the tank opening 21 within the tank interior. The combustion chamber 27 includes an elongate body portion having an open end 29 located adjacent the opening 21 in the closed tank exterior into which combustible fuel is introduced and ignited in the presence of air to create products of combustion. In the embodiment of FIG. 1, the combustion chamber 27 is a submergible combustion chamber which includes a mounting portion 31 for detachably engaging, a flange provided adjacent the tank opening 21 for mounting the combustion chamber assembly within the tank. The mounting flange can be a ring-like body having an opening in the central part thereof which opening coincides with the opening in the open end of the combustion chamber.

The combustion chamber 27 shown in FIG. 1 also includes a plurality of fire tubes 33 each of which has an end 35 which communicates with a closed end 37 of the combustion chamber 27 opposite the open end 29. Each fire tube also has an opposite end 39 which extends through the opening 21 when in place on the tank 13 to the tank exterior. Each of the fire tubes 33 is characterized in that at least a portion of the length thereof is generally U-shaped. In the configuration shown in FIG. 1 the combustion chamber 27 extends substantially the length of the fire tubes 33 creating a long leg 41 running along the exterior of the combustion chamber and separated by a U-shaped bend from a short leg 43 which joins and extends through the closed end 37 of the combustion chamber.

The ends 39 of the fire tubes 33 communicate through the mounting components of the combustion chamber when the combustion chamber is received within the sidewall opening 21. Further details of the construction and mounting of the combustion chamber assembly are shown in U.S. Pat. No. 4,545,329, issued Oct. 8, 1985, to PVI Industries, Inc., the disclosure of which is incorporated herein by reference.

The fire tubes 33, in this case, comprise passage means for conducting products of combustion present within the combustion chamber 27 to the exterior of the closed tank 13 for exhaustion to the atmosphere. The fire tubes 33 also comprise the second pass of a two-pass combustion assembly, since the products of combustion first pass inwardly within the combustion chamber and then outwardly through the fire tubes to the flue collector. As will be apparent, the combination flue gas collector, burner could also be used with 3, 4, 5 etc. pass devices, since it is not necessary that the flue collector also be the flue outlet of the device.

A flue collector 45 is mounted on the exterior of the closed tank 13. The flue collector 45 has a flue opening (47 in FIG. 6) which communicates with the open end (29 in FIG. 1) of the body portion of the combustion chamber 27. The flue collector 45 also has an annular chamber 49 which surrounds the flue opening 47 and which is separated therefrom. The annular chamber 49 communicates with the passage means, in this case fire tubes 33, for conducting products of combustion to the annular chamber where they are exhausted through an exhaust duct 51 to the atmosphere. The products of combustion could also be re-routed through the device in the case of 3, 4, 5 etc. pass devices.

Figure 2:
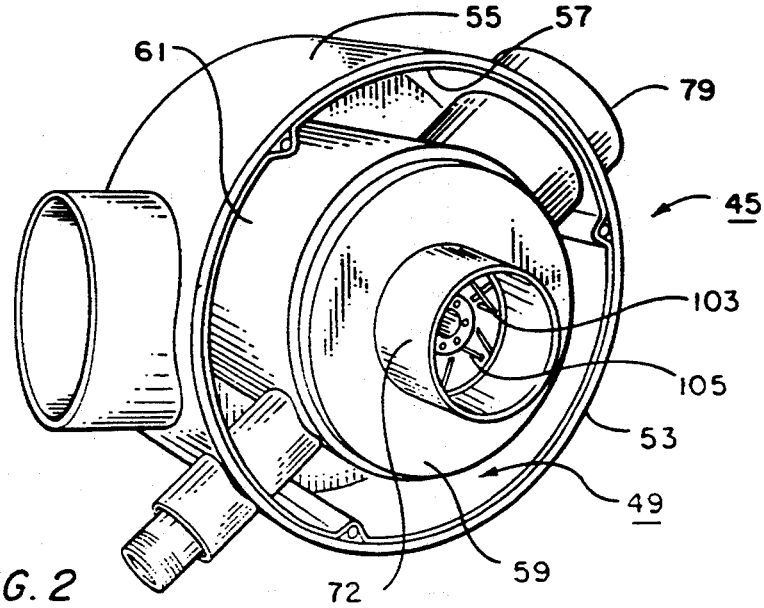
FIG. 2 is an isolated view of the combination burner and flue gas collector of FIG. 1 showing the interior thereof.

FIG. 2 shows the interior of the flue collector 45 in greater detail. As shown in FIG. 2, the flue collector 45 has a generally cylindrical outer housing 53 having an exterior sidewall 55 and an interior sidewall 57. A generally cylindrical inner housing 59 is centrally located within the outer housing 53 and has an exterior sidewall 61 which is spaced apart from the interior sidewall 57 of the outer housing 53 to thereby create an annular chamber 49 therebetween. The inner housing 59 also has an open interior (63 in FIG. 3) which defines a flue opening for the collector which communicates with the combustion chamber 27. The annular chamber 49 has at least one inlet (65 in FIG. 6) for receiving products of combustion from the combustion chamber 27 and at least one outlet, such as duct 51, for exhausting such products to the atmosphere.

Figure 3:
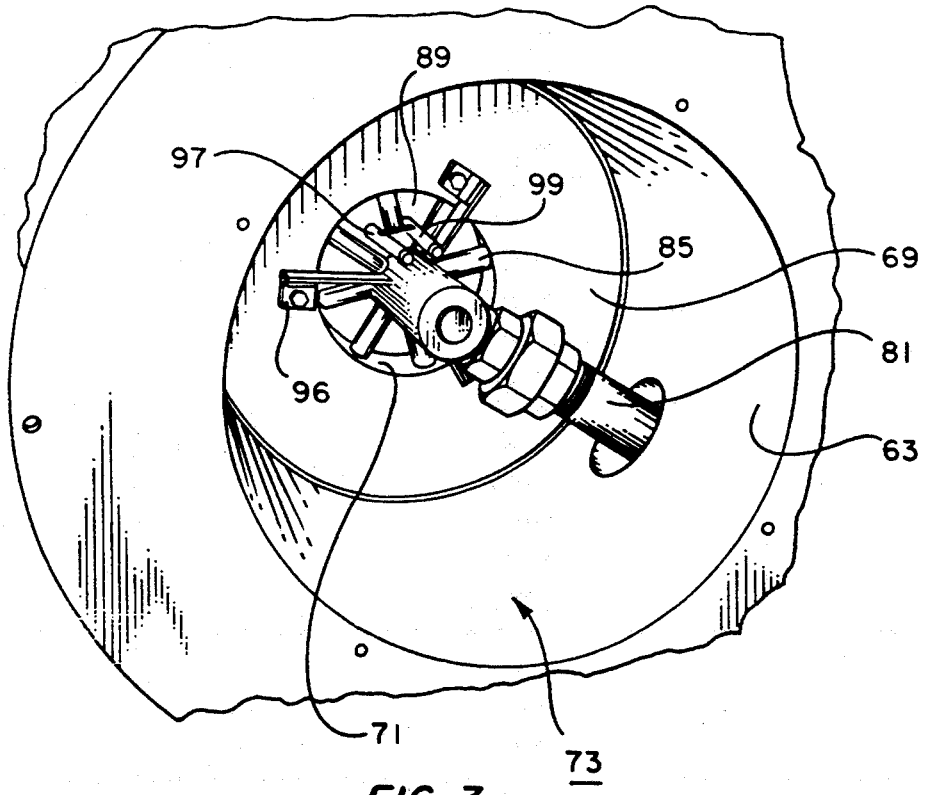
FIG. 3 is a view of a portion of the flue collector of FIG. 2, viewed from the opposite direction, showing the combustion means mounted therein.

The flue collector has an outer wall portion (67 in FIG. 1) which defines a closed end for the flue opening of the flue collector at one extent thereof. The flue collector also has an oppositely arranged inner wall portion (69 in FIG. 3) which together with the outer wall portion defines a closed compartment within the flue collector which is surrounded by but separated from the annular chamber 49. As seen in FIG. 3, the inner wall portion 69 has a central opening 71 therein which communicates with the combustion chamber 27. A cylindrical blast tube 72 extends from the central opening 71 and houses combustion means for producing combustion.

Figure 6:
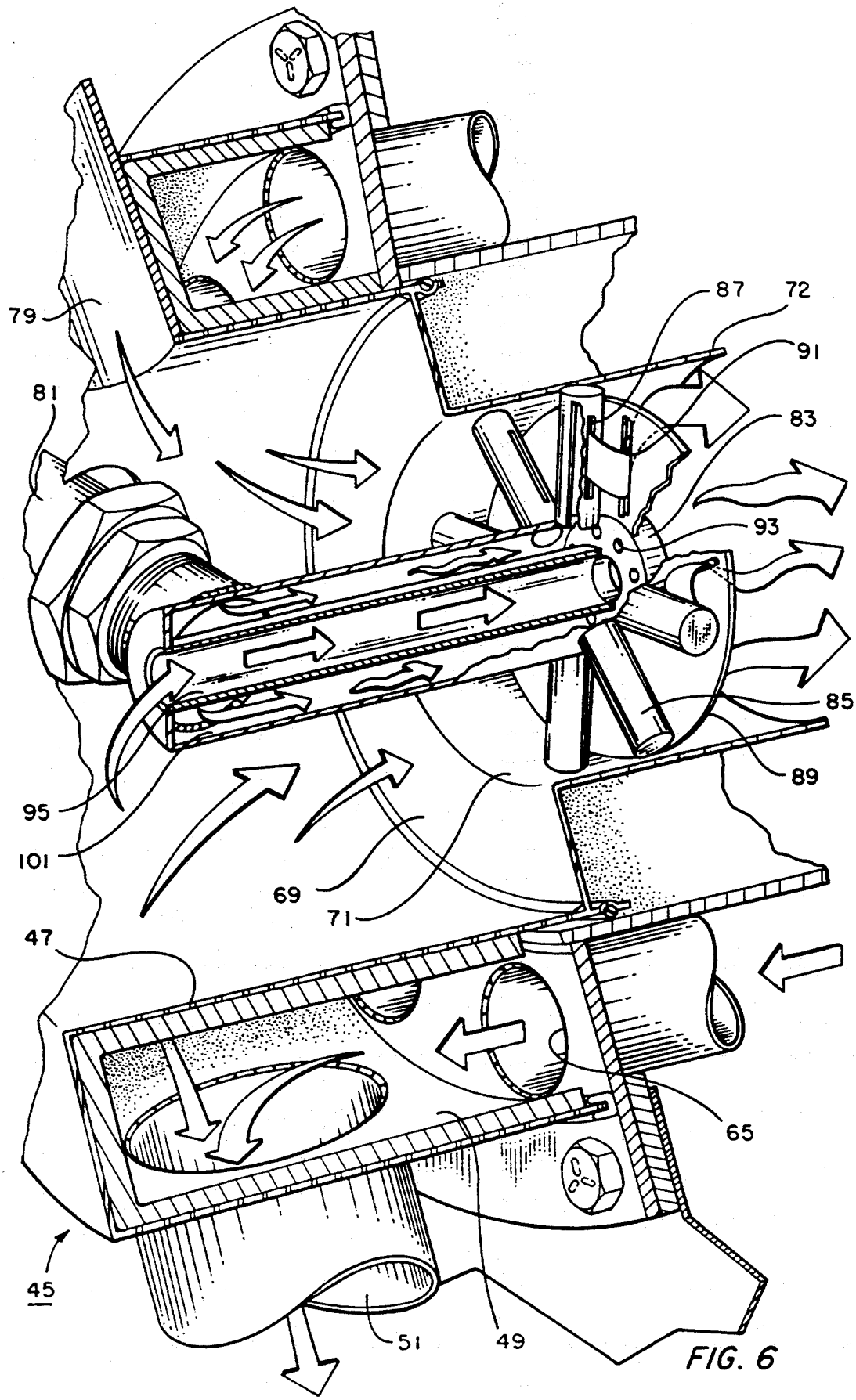
FIG. 6 is a schematic view of the collector mounted on a water heater with portions of the tank and collector broken away to illustrate the flow of fuel, combustion air and exhaust products within the unit.

Blower means are provided for pressurizing the closed compartment, illustrated as 73 in FIG. 3. The blower means can conveniently comprise a fan unit (75 in FIG. 1) which, in this case, is remotely located from the water heater tank 13 and which is connected to the closed compartment 73 of the flue collector by a suitable conduit 77. Although the fan unit 75 is shown remotely located in FIG. 1, it will be understood that it could be attached directly to the flue collector 45. Because the conduit 77 is not exposed to extreme temperatures, it can be comprised of a light weight, inexpensive synthetic material such as PVC. As shown in FIGS. 2 and 6, the conduit 77 communicates with the closed compartment 73 of the flue collector by means of a duct 79 which passes transversely through the annular chamber 49 of the flue collector to the closed chamber.

Combustion means are mounted within the blast tube 72 which extends from the central opening (71 in FIG. 3) in the inner wall portion 69 of the flue collector for producing combustion. The combustion means includes a supply means for supplying fuel from a fuel source and an ignition means for igniting the fuel in the presence of air to produce products of combustion within the combustion chamber.

As shown in FIGS. 3 and 6, the supply means for supplying fuel to the combustion chamber is a fuel supply conduit 81 connected to a source of combustible fuel (not shown) at an outer end thereof and having an inner end 83 which extends within the blast tube 72 provided within the inner wall portion 69 of the flue collector. For gas fired appliances, the inner end 83 of the fuel supply conduit includes a plurality of radially extending fingers or spiders 85. Each spider has an opening such as slit 87 therein for supplying fuel to the central opening of the flue collector. The fuel being supplied can be, for example, natural gas.

As shown in FIG. 6, the fuel supply conduit has a pressure plate 89 mounted thereon having a plurality of apertures 91 therein. The pressure plate 89 is adapted to be received within the central opening 71 of the flue collector to facilitate the pressurization of the closed chamber by the blower means. The inner end 83 of the fuel supply conduit also includes a plurality of fuel supply openings 93 which supply fuel downstream of the pressure plate 89. As shown in FIG. 3, the fuel supply conduit with its spiders 85 and associated pressure plate 89 can be mounted on the inner wall portion 69 of the flue collector, as by mounting brackets 96. As best seen in FIG. 6, the fuel supply conduit 81 also has a central bore 95 which allows air from the closed chamber 73 to pass to the downstream side of the pressure plate 89.

The ignition means can conveniently comprise a pair of electrodes (97, 99 in FIG. 3) which are connected to conventional circuitry for producing a timed spark on the downstream side of the pressure plate 89 for igniting the fuel and air mixture to produce products of combustion within the combustion chamber.

Figure 4:
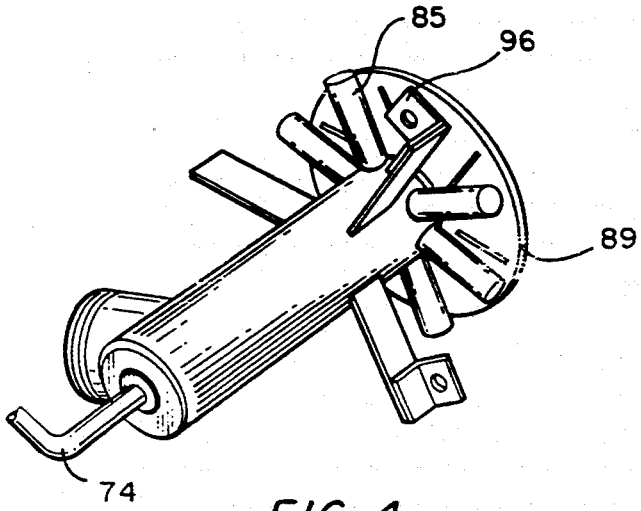
FIG. 4 is an isolated view of a fuel supply means and pressure plate which are components of the combustion means of the collector.
Figure 5:
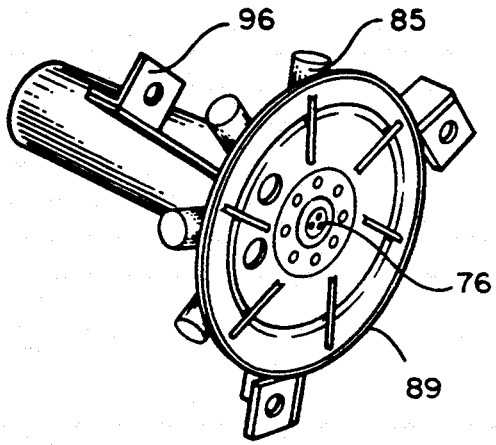
FIG. 5 is a perspective view, similar to FIG. 4, but showing the opposite face of the pressure plate.

FIGS. 4 and 5 also show a combustion means similar to that shown in FIG. 3, but modified for use with oil. In the embodiment of FIG. 4, an oil inlet line 74 supplies oil from a remote source (not shown) to an oil nozzle (76 in FIG. 5) located on the downstream side of the pressure plate 89. The operation of the oil combustion means of FIGS. 4 and 5 is the same as that previously described except that oil is typically supplied to oil burners at a pressure over 100 psig but under 500 psig. Multiple oil nozzles might also be utilized.

The operation of the apparatus of the invention will now be described. In operation, the blower unit 75 pressurizes the closed compartment 73 which is defined within the interior of the inner housing 59, inner wall portion 69 and outer wall portion 67 of the flue collector. A suitable fuel, such as natural gas is supplied through the supply conduit 81 to the spiders 85 and openings 93 of the burner. If oil is used as the fuel, it would be supplied to the oil nozzle (76 in FIG. 5). In the case of gas appliance, gas exiting the slits 87 in the spiders 85 is mixed with air within the closed chamber 73 and passes through the slits 91 in the pressure plate 89 to continue downstream within the central opening 71 leading to the combustion chamber 27. Gas also passes through the outer shell 101 of the fuel supply conduit through the openings 93 to the downstream side of the pressure plate 89. Electrical current supplied to the electrodes 97, 99 causes a spark between the exposed ends (103, 105 in FIG. 2) on the downstream side of the pressure plate 89 causing combustion within the combustion chamber 27. The products of combustion travel through the interior of the combustion chamber and are routed through the fire tubes 33 and inlets (65 in FIG. 6) to the annular chamber 49 of the flue collector where they are exhausted through the exhaust duct 51 to the atmosphere.

An invention has been provided with several advantages. The combination burner and flue gas collector of the invention is simple in design and economical to manufacture. The simplicity of the construction and arrangement of the component parts improve serviceability of the unit. Because the flue collector incorporates the burner within the interior of the collector housing, the overall dimensions of the unit are decreased, allowing the burner/collector to be assembled with the tank at the factory, prior to shipment. Because the fan unit can be remotely located, it can be configured in any convenient manner to accommodate the location of the water heater in use. For example, the fan unit could be located outside a building to reduce the noise level or can be located immediately adjacent the water heater within a building. Because the fan unit can be remotely located, and because it is not exposed to extremes of temperature, it can be connected to the closed chamber of the collector by inexpensive, non-insulated conduit. Because combustion occurs on the downstream side of the pressure plate of the collector, it is not necessary to employ heavy insulation to separate the annular chamber from the closed compartment of the collector. The unit can be utilized with natural gas, LP gas, fuel oil, heavy oil, methane and other suitable fuels.

While the invention has been shown in only one of its forms, it is not thus limited but is susceptible to various changes and modifications without departing from the spirit thereof.

What is claimed is:

1. A water heater or boiler having a closed tank with an exterior and an interior, the exterior having an opening therein, the interior normally containing water, the improvement comprising:

a combustion chamber located within the tank interior, the combustion chamber including a body portion having an open end located adjacent the opening in the closed tank exterior into which combustible fuel is introduced and ignited in the presence of air to create products of combustion;

passage means for conducting products of combustion present within the combustion chamber to the exterior of the closed tank;

a flue collector mounted on the exterior of the closed tank having a flue opening therein which communicates with the open end of the body portion of the combustion chamber, the flue collector having an annular chamber surrounding the flue opening and separated therefrom, the annular chamber communicating with the passage means for receiving the products of combustion;

an outer wall portion which defines a closed end for the flue opening at one extent thereof and an oppositely arranged, inner wall portion which together with the outer wall portion defines a closed compartment within the flue collector which is located externally of the combustion chamber and which is surrounded by but separated from the annular chamber, the inner wall portion having an opening therein which communicates with the combustion chamber;

blower means for pressurizing the entire closed compartment with air;

combustion means mounted within the opening in the inner wall portion of the flue collector for producing combustion, the combustion means including supply means for supplying fuel from a fuel source and an ignition means for igniting the fuel in the presence of air to produce products of combustion within the combustion chamber;

wherein the blower means is a fan unit remotely located from the water heater and connected to the closed compartment of the flue collector by a conduit; and wherein the blower conduit communicates with the closed compartment of the flue collector by means of a duct which passes transversely through the annular chamber of the flue collector directly to the closed chamber.

2. The water heater or boiler of claim 1, wherein the body portion of the combustion chamber comprises a readily removable and submergible module with a closed end opposite the open end and having multiple external heating surfaces.

3. A water heater or boiler having a closed tank with an exterior and an interior, the exterior having an opening therein, the interior normally containing water, the improvement comprising:

a combustion chamber located within the tank interior, the combustion chamber including a body portion having an open end located adjacent the opening in the closed tank exterior into which combustible fuel is introduced and ignited in the presence of air to create products of combustion;

passage means for conducting products of combustion present within the combustion chamber to the exterior of the closed tank;

a flue collector mounted on the exterior of the closed tank having a flue opening therein which communicates with the open end of the body portion of the combustion chamber, the flue collector having an annular chamber surrounding the flue opening and separated therefrom, the annular chamber communicating with the passage means for receiving the products of combustion;

an outer wall portion which defines a closed end for the flue opening at one extent thereof and an oppositely arranged, inner wall portion which together with the outer wall portion defines a closed compartment within the flue collector which is surrounded by but separated from the annular chambers, the inner wall portion having an opening therein which communicates with the combustion chamber;

blower means for pressurizing the closed compartment with air;

combustion means mounted within the opening in the inner wall portion of the flue collector for producing combustion, the combustion means including supply means for supplying fuel from a fuel source and an ignition means for igniting the fuel in the presence of air to produce products of combustion within the combustion chamber;

wherein a pressure plate having a plurality of apertures therein is located within a blast tube extending from the central opening provided in the inner wall portion of the flue collector closed chamber to thereby facilitate the pressurization of the closed chamber by the blower means; and wherein the inner end of the fuel supply conduit includes a plurality of radially extending fingers, each finger having an opening therein for supplying fuel to the central opening of the flue collector at a location upstream of the pressure plate.

4. The water heater or boiler of claim 3, wherein the inner end of the fuel supply conduit also includes a plurality of fuel supply openings located on a downstream face of the pressure plate.

5. The water heater or boiler of claim 4, wherein the ignition means is at least one pair of electrodes mounted on the downstream face of the pressure plate for producing ignition of the fuel and air entering the combustion chamber.

6. A combination burner and flue gas collector of the type adapted to be mounted on an exterior wall of a water heater or boiler having a closed tank with a wall opening and a combustion chamber communicating with the wall opening, the collector comprising:

a generally cylindrical outer housing having an exterior sidewall and having an interior sidewall;

a generally cylindrical inner housing centrally located within the outer housing and having an exterior sidewall which is spaced apart from the interior sidewall of the outer housing to thereby create an annular chamber therebetween, the inner housing having an open interior which defines a flue opening for the collector which communicates with the combustion chamber, the annular chamber having at least one inlet for receiving products of combustion from the combustion chamber and one outlet for exhausting such products to the atmosphere;

wherein the inner housing has an outer wall portion which defines a closed end for the flue opening at one extent thereof and an oppositely arranged, inner wall portion which together with the outer wall portion defines a closed compartment within the flue collector which is located externally of the combustion chamber and which is surrounded by but separated from the annular chamber, the inner wall portion having an opening therein which communicates with the combustion chamber;

a blower duct which passes transversely through the annular chamber of the collector directly to the closed compartment for pressurizing the entire closed compartment when the duct is connected to an external source of air pressure;

combustion means mounted within the opening in the inner wall portion of the collector for producing combustion, the combustion means including supply means for supplying fuel from a fuel source and an ignition means for igniting the fuel in the presence of air to produce products of combustion within the combustion chamber.

7. A combination burner and flue gas collector of the type adapted to be mounted on an exterior wall of a water heater or boiler having a closed tank with a wall opening and a combustion chamber communicating with the wall opening, the collector comprising:

a generally cylindrical outer housing having an exterior sidewall and having an interior sidewall;

a generally cylindrical inner housing centrally located within the outer housing and having an exterior sidewall which is spaced apart from the interior sidewall of the outer housing to thereby create an annular chamber therebetween, the inner housing having an open interior which defines a flue opening for the collector which communicates with the combustion chamber, the annular chamber having at least one inlet for receiving products of combustion from the combustion chamber and one outlet for exhausting such products to the atmosphere;

wherein the inner housing has an outer wall portion which defines a closed end for the flue opening at one extent thereof and an oppositely arranged, inner wall portion which together with the outer wall portion defines a closed compartment within the flue collector which is surrounded by but separated from the annular chamber, the inner wall portion having an opening therein which communicates with the combustion chamber;

a blower duct which passes transversely through the annular chamber of the collector to the closed compartment for pressurizing the closed compartment when the duct is connected to an external source of air pressure;

combustion means mounted within the opening in the inner wall portion of the collector for producing combustion, the combustion means including supply means for supplying fuel from a fuel source and an ignition means for igniting the fuel in the presence of air to produce products of combustion within the combustion chamber;

wherein a pressure plate having a plurality of apertures therein is located within a blast tube which extends from the central opening provided in the inner wall portion of the closed chamber to thereby facilitate the pressurization of the closed chamber by air entering the chamber through the blower duct;

wherein the supply means for supplying fuel to the combustion chamber is a fuel supply conduit connected to a source of combustible fuel at an outer end and having an inner end which extends within the central opening provided within the inner wall portion of the collector; and wherein the inner end of the fuel supply conduit includes a plurality of radially extending fingers, each finger having an opening therein for supplying fuel to the central opening of the flue collector at a location upstream of the pressure plate.

8. The combination burner and flue gas collector of claim 7, wherein the inner end of the fuel supply conduit also includes a plurality of fuel supply openings located on a downstream face of the pressure plate.

9. The combination burner and flue gas collector of claim 8, wherein the ignition means is at least one pair of electrodes mounted on the downstream face of the pressure plate for producing ignition of the fuel and air entering the combustion chamber.

* * * * *